United States Patent [19]

Fellgett

[11] 4,251,685

[45] Feb. 17, 1981

[54] REPRODUCTION OF SOUND

[75] Inventor: Peter B. Fellgett, Reading, England

[73] Assignee: National Research Development Corporation, London, England

[21] Appl. No.: 430,519

[22] Filed: Jan. 3, 1974

Related U.S. Application Data

[63] Continuation of Ser. No. 222,744, Feb. 2, 1972, abandoned.

[30] Foreign Application Priority Data

Feb. 2, 1971 [GB] United Kingdom ..... 3698/71
Nov. 9, 1971 [GB] United Kingdom ..... 52008/71

[51] Int. Cl.³ ..... H04S 3/02
[52] U.S. Cl. ..... 179/1 GQ; 369/89
[58] Field of Search ..... 179/1 Q, 100.4 ST. 1 GH. 179/100.1 TD

[56] References Cited

U.S. PATENT DOCUMENTS

| | | | |
|---|---|---|---|
| 3,813,494 | 5/1974 | Bauer | 179/1 GQ |
| 3,856,992 | 12/1974 | Cooper | 179/1 GQ |

OTHER PUBLICATIONS

Analysing Phase Amplitude Matrices by Scheiber, Audio Engineering Society, Preprint Oct. 8, 1971.
Discrete-Matrix Multichannel Stereo by Cooper et al., Journal Audio Engineering Society, Jun. 72, pp. 346-360, presented Oct. 7, 1971.

*Primary Examiner*—Douglas W. Olms
*Attorney, Agent, or Firm*—Cushman, Darby & Cushman

[57] ABSTRACT

In a sound reproduction system which enables the listener to distinguish between signals from in front and behind as well as signals on the left and the right, only two independent transmission channels are employed. The contributions to the signals in the two transmission channels relating to a sound source at a particular azimuth have the same amplitude and frequency and differ in phase by an amount indicating the azimuth of such source.

5 Claims, 12 Drawing Figures

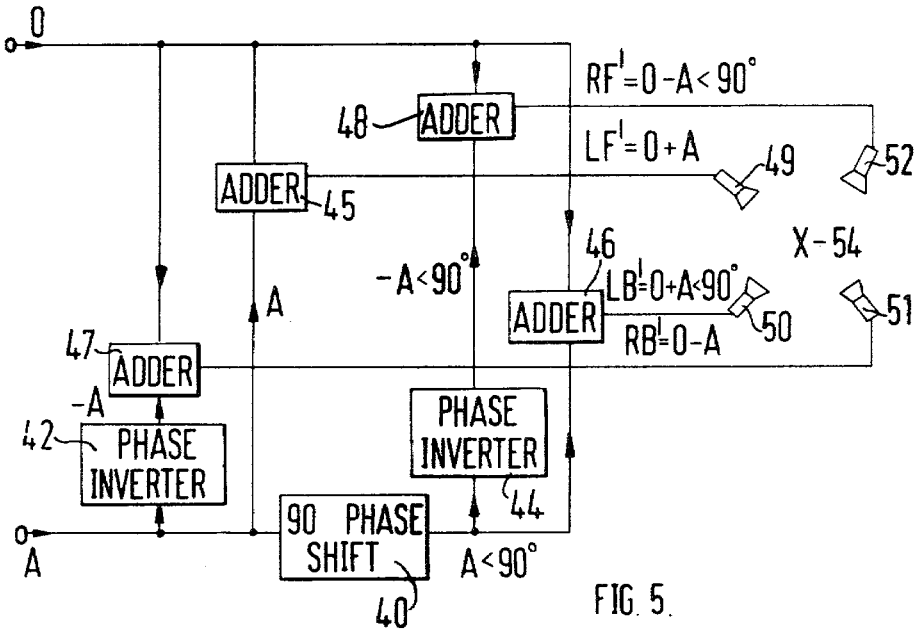
FIG. 5.
FIG. 6.
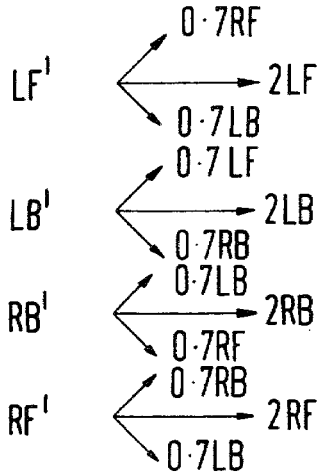

REPRODUCTION OF SOUND

This is a continuation of application Ser. No. 222,744 filed Feb. 2, 1972 now abandoned.

This invention relates to reproduction of sound.

Systems are known in which the realism and aesthetic quality of reproduced sound can be enhanced by having a number of transducers, each comprising a microphone or a system of microphones, each trasducer feeding through an independent channel to a respective loudspeaker. The various loudspeakers are disposed relative to the listener in a manner which is suitably related to the distribution of microphones relative to the original source of sound. The so-called "stereo" reproduction system, employing two independent channels, is well known. The loudspeakers are usually disposed one in front of and to the left of the listener and the other in front of and to the right of the listener. These are fed with signals which are referred to respectively as the left-channel signal and the right-channel signal.

If, with this system, the source of sound moves once through 360° in azimuth about the microphones the source may appear to the listener to come from the following directions:

| Actual direction of source | Apparent direction of source |
|---|---|
| 0° (= from front) | 0° |
| 45° | 45° |
| 90° (= from right) | indefinite |
| 180° (= from rear) | 0° |
| 270° (= from left) | indefinite |
| 315° | 315° |

A consistent description of this behaviour is that when the source rotates once in azimuth it seems approximately to the listener to move twice around a circle having a diameter extending forward from the listener.

The reason for this behaviour will become apparent when considering the information produced by one type of stereo microphone system. This system employs two microphones each having a "figure-of-eight" variation of sensitivity with direction of incident sound, the two figure-of-eight patterns being oriented at right angles to each other in the horizontal plane. Using the same frame of reference as above, the microphone has a positive lobe at 45° and a negative lobe at 225° while the other has its positive lobe at 315° and its negative lobe at 135°. The only difference between a signal originating from in front of the microphones and a signal originating from behind them is one of phase. In the absence of a reference signal, this difference cannot be detected at the loudspeakers.

It is an object of the present invention to provide a sound reproduction system which enables the listener to distinguish between signals from in front and behind, as well as between signals from the left and right, employing only two independent transmission channels and so that it can be used on existing systems for stereo transmission. According to the invention this is done by arranging for the contributions to the signals in the two channels relating to any one azimuth to differ in phase by an amount indicating the azimuth of the corresponding sound. It should be realised that, in principle, two channels of audio bandwidth are sufficient to define both the waveform of an incidence soundwave and its direction of arrival.

It should be understood that the term "transmission channel" is used herein to include both a channel which has only transmission capabilities such as a radio broadcast channel and a channel which includes storage capacity such as that provided by a recording system, a record medium and a reproducing system when used in conjunction with one another. In the latter case, there is obviously no reason why the recording system and reproducing system should necessarily be parts of the same apparatus. Where the record medium is a gramophone record, this is unlikely to be so.

According to the invention, in one aspect, a transmitter for a multi-channel sound reproduction system having two transmission channels, comprises means for applying a respective audio signal to each transmission channel, said audio signals being so interrelated that there exists a linear combination thereof which is resolvable into two components of equal amplitude and frequency, the difference in phase between said components being related to the angle between the direction from which sound represented by said audio signals is intended to be heard and a predetermined reference direction.

Preferably said audio signals themselves are of equal amplitude and frequency and the difference in phase between said audio signals is equal to the angle between the direction of which sound represented by said audio signals is intended to be heard and a predetermined reference direction. It should be realised that, in practice, the system will be transmitting more than one pair of audio components at any one time and that each such pair may represent sound originating from a different direction.

According to a feature of the invention, an integral transducer unit for use at the transmitter end comprises a first transducer, such as a microphone, arranged responsive to incident sound waves to generate a first electrical signal and a second similar transducer arranged to generate a second electrical signal equal in amplitude and frequency to that generated by the first signal but the phase of which differs from the phase of the first electrical signal by an amount dependent on the direction of incidence of said sound waves.

The second transducer may consist of two microphones each having a figure-of-eight variation of sensitivity with direction of incident sound, the two figure-of-eight patterns being oriented at right angles to each other in the horizontal plane. Conveniently, the variation of sensitivity follows a cosine law. The signal from one of the figure-of-eight microphones is shifted in phase by 90° relative to the signal from the other and these two signals are then added to form the output of the composite azimuth transducer. The necessary wideband phase shifting can be performed by what are known as all-pass filters.

An alternative arrangement in accordance with the invention for originating the composite signals comprises at least one transducer such as a microphone connected to means for producing two electrical signals, from each of which can be derived the amplitude and frequency of the sound detected by the transducer, the phase differing between the two signals by a predetermined amount in accordance with the direction from which the sound detected by the microphone is intended to be heard by the listener.

Alternative arrangements for originating the composite signals may be used together. For example, a transducer unit incorporating two microphones may be used to produce the main signals while additional single microphones connected to means for producing two electrical signals are used to reinforce the signal heard by the listener from a particular direction in order to obtain enhanced or special effects.

According to the invention, in another aspect, a decoder for a multi-channel sound reproduction system, comprises two inputs and at least three outputs and adapted to produce at each output a signal dependent on at least one of said inputs, the signal at at least one of said outputs comprising a combined signal which comprises the sum of two components having amplitudes in equal proportion to, and each being identical in frequency with, a respective one of the two input signals, the phase difference between each of the two components being adjusted relative to the phase difference between the signals at the two inputs by an amount uniquely characteristic of an angular position with which such output is to be associated.

Preferably the signals at all outputs are combined signals of the kind specified. It is, however, possible to arrange for two of the output signals to each be dependent only on a respective one of the two input signals. Where all outputs are combined signals, the most economical use of equipment is achieved if it is arranged for the phase difference at one of the outputs to be zero.

It should be understood that since the multiplicity of component signals in each channel consists of a continuum of signals rather than a set of discrete signals, a loudspeaker at any azimuth orientation round the position to be occupied by the listener can be supplied with an appropriate signal from apparatus in accordance with the invention by arranging for the decoder to effect an adjustment corresponding to such orientation in the phase difference between the two signals fed to such loudspeaker.

The invention will be more readily understood from the following description, by way of example, with reference to the accompanying drawings, in which:

FIG. 5 is a block diagram illustrating in more detail the apparatus at the receiving end in the embodiment shown in FIG. 3;

FIG. 6 is a phasor diagram illustrating the operation of the apparatus shown in FIG. 5;

Whenever in the following descriptions the invention, a phase shift between any two signal channels is specified, this phase shift is preferably implemented using all-pass filters. It is to be understood that, in accordance with known art, such all-pass filters may include elements in both of the two signal paths between which the phase shift is required, such elements being so arranged as to shift absolutely the phase of both the channels while maintaining the relative phase shift, which is equal to the difference between the two absolute phase shifts, at or near the prescribed value. For brevity of description and clarity of the drawings, only the relative phase shift will be referred to and this will be illustrated in only one of the two paths. The path to which the phase shift is applied will be referred to as the azimuth channel A and the other path as the omni-directional channel O. It should be understood that, in practice, phase shifting may take place in either or both channels. Further, it is preferable that additional all-pass filters are incorporated, for example at the transmitter, so as to give phase shifts which cause the total phase shift suffered by any signal component in its whole pasage through the system to approximate to a pure time delay which is equal for each source.

Figure 1:
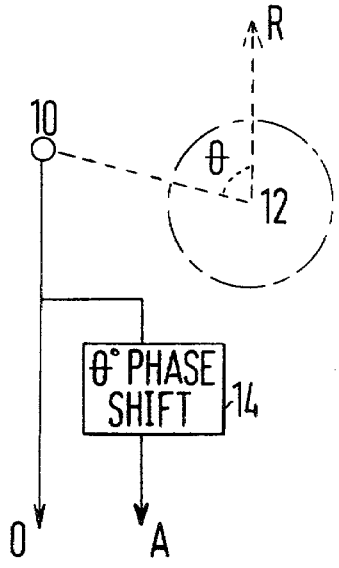
FIG. 1 is a block diagram illustrating a basic component of apparatus at the transmitting end in accordance with the invention.

FIG. 1 shows a microphone 10 arranged to receive sound from an area 12 containing a sound source hereinafter called "the sound stage". This microphone 10 is disposed at an orientation relative to a centre of the area 12 by an angle $\theta$ relative to a reference direction indicated by arrow R. The output from the microphone 10 is applied directly to an omni-directional transmission channel O and, via a circuit 14 producing a phase shift of $\theta°$ to an azimuth transmission channel A.

In accordance with the invention, any microphone 10 at any azimuth can contribute to the two composite signals in the transmission channels O and A, the signal to be supplied to a loudspeaker disposed at any orientation relative to a listener. In order to obtain discrimination in two orthogonal directions, at least three microphones 10 are required. It is preferable, but not essential, for such microphones to be spaced around the sound stage 12 in such a way that the maximum angle between adjacent microphones is less than 180°.

Figure 2:
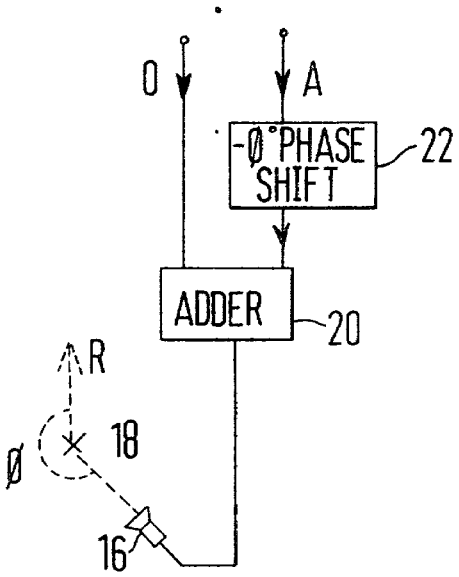
FIG. 2 is a block diagram, similar to FIG. 1, illustrating the corresponding apparatus at the receiving end.

FIG. 2 illustrates the apparatus at the receiver necessary to feed a single loudspeaker 16 confronting a listening position 18 and disposed at an orientation $\phi$ relative to the reference direction R. The composite signal received in the omni-directional channel O is applied directly to an adder 20 and the composite signal in the azimuth channel A is applied to adder 20 via a circuit 22 which gives a phase shift of $-\phi°$. Similar apparatus is provided to feed other loudspeakers (not shown) disposed at other orientations round the listening position 18.

As already mentioned, there is no reason why all of these shifting circuits need be in the azimuth channel A. For example the phase shifting circuit 22 could be disposed in the omni-directional channel O, in which case it would be necessary for the phase shift applied to be $+\phi°$.

Figure 3:
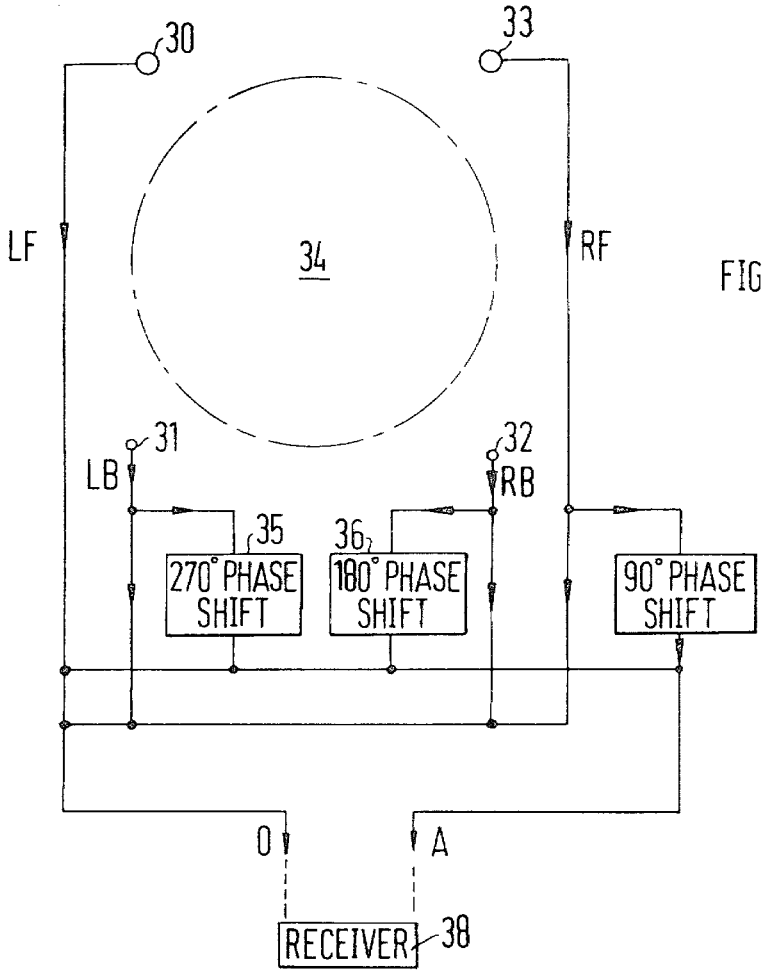
FIG. 3 is a block diagram of an embodiment of the invention.

FIG. 3 illustrates a system employing four microphones 30, 31, 32 and 33 symmetrically disposed about a sound stage 34 containing sound sources. The four microphones 30, 31, 32 and 33 are preferably so constructed that provided sounds originate from within the sound stage 34, the output from the individual microphones is not strongly dependent on the precise angle of incidence of sound waves thereon.

The outputs from all four microphones 30, 31, 32 and 33 are all connected directly to an omni-directional transmission channel O. The microphone 30 is also connected directly to an azimuth transmission channel A while the other three microphones 31, 32 and 33 are connected to the azimuth channel A via respective circuits 35, 36 and 37 which produce phase shifts of 270°, 180° and 90° respectively. Thus, it will be seen that the phase shift applied is equal to the angle between a line joining the corresponding microphone and the centre of the sound stage 34 and a line joining a reference position, in this case the microphone 30 and the centre of the area 34.

At the receiving end, the omni-directional and azimuth signals are applied to receiver 38, which will be described below with reference to FIG. 5.

Figure 4:
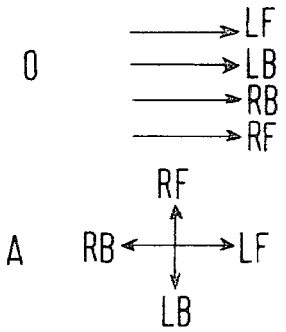
FIG. 4 is a phasor diagram illustrating the operation of the embodiment shown in FIG. 3.

FIG. 4 is a set of phasor diagrams illustrating the signals in the omni-directional and azimuth channels, the signal LF originating from the microphone 30, the signal LB from the microphone 31, the signal RB from the microphone 32 and the signal RF from the microphone 33.

FIG. 5 shows the receiver 38 of FIG. 3 in greater detail. The received azimuth signal A is applied both to a 90° phase shift circuit 40 and a phase inverter 42. The output of the phase shift circuit 40 is also applied to another phase inverter 44. Thus four signals having the same amplitude and frequency but differing in phase by successive increments of 90° are produced and these are combined in respective adders 45 to 48 with the received omni-directional signal O. The outputs of the adders 41 to 44 are applied to four loudspeakers 49 to 52 in accordance with the Table I.

TABLE I

| Adder | Signal | Loudspeaaker | Loudspeaker Position |
|---|---|---|---|
| 45 | 0 + A | 49 | Left Front |
| 46 | 0 + A (phase angle + 90°) | 50 | Left Back |
| 47 | 0 − A | 51 | Right Back |
| 48 | 0 − A (phase angle + 90°) | 52 | Right Front |

FIG. 6 shows the phasor diagrams for the signal LF at the loudspeaker 49, LB from the loudspeaker 50, RB from the loudspeaker 51 from the loudspeaker 52. It will be seen that each loudspeaker received a dominant in-phase signal from the corresponding microphone and smaller signals, 45° out of phase in opposite directions, from the two adjacent microphones.

Figure 7:
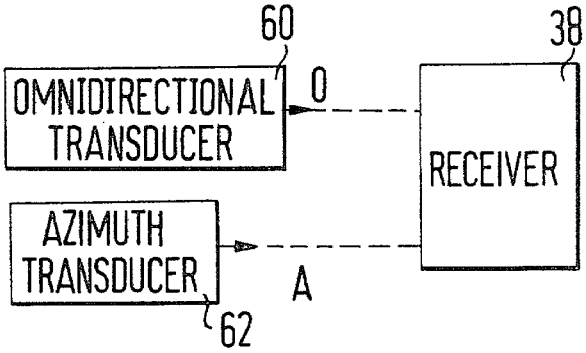
FIG. 7 is a block diagram of another embodiment of the invention, also employing the apparatus of FIG. 5 at the receiving end.

FIG. 7 illustrates an alternative embodiment of the invention in which an integral transducer unit, which may, for example, be located at the centre of the sound stage, is used at the transmitter end. This comprises an omni-directional transducer 60, the output signal of which is substantially independent of the direction of incidence of the sound thereon, and an azimuth transducer 62. The output of the omni-directional transducer 60 is connected to the omni-directional channel O and that of the azimuth transducer 62 to the azimuth channel A.

Figure 8:
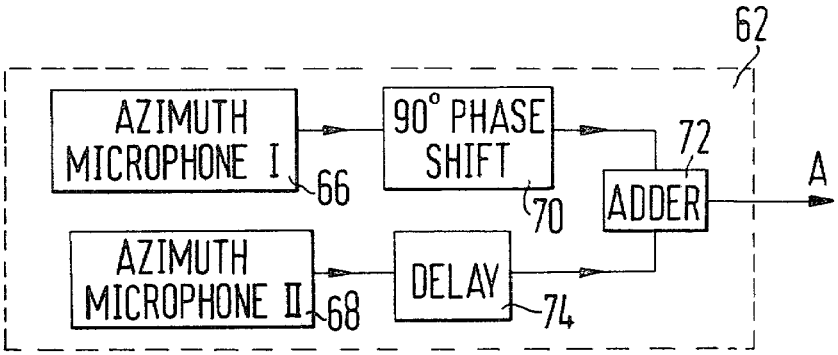
FIG. 8 is a block diagram of one of the transducers at the transmitting end of the embodiment shown in FIG. 7.

Referring to FIG. 8, the azimuth transducer 62 consists of a pair of microphones 66 and 68 each having a figure-of-eight variation of sensitivity according to a cosine law, the two figure-of-eight patterns being oriented at right angles in the horizontal or azimuth plane. The output of the first azimuth microphone 66 is applied, via a circuit 70 which produces a 90° phase shift, to one input of an adder 72. The output of the second azimuth microphone 68 is applied via a delay circuit 74, which imposes a time delay equal to that imposed by the 90° phase shift circuit 70 but does not cause any change of phase, to the other input of the adder 72. If the time delay imposed by the 90° phase shift circuit 30 is negligible, the delay circuit 34 can be omitted. Alternatively, both the circuits 70 and 74 may be arranged to produce a phase shift such that the phase difference between their outputs is 90°. For example, the circuit 70 may be arranged to produce a phase shift of +45° and the circuit 74 a phase shift of −45° relative to the omni-directional channel O.

Figure 9:
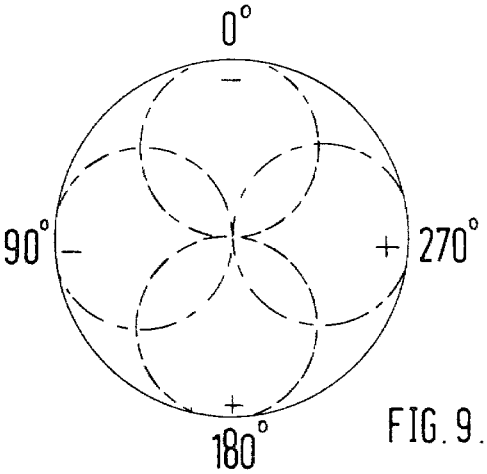
FIG. 9 is a polar diagram illustrating the sensitivity of the transducers at the transmitting end of the systems shown in FIG. 7.

Referring to FIG. 9, the positive lobe of the figure-of-eight pattern of the second microphone 68 (shown in chain-dotted lines) is conveniently directed in azimuth 90°, and that of the first azimuth microphone 66 (shown in dashed lines) in azimuth 180°. The omni-directional microphone consists of a microphone having uniform sensitivity through 360° of azimuth as shown by a solid line in FIG. 3.

As before, the receiver 38 may take the form illustrated in FIG. 5. However, it will be realised that the signal intended to be heard from the right hand side will be produced by the loudspeaker 49, that to be heard from the front by the loudspeaker 50, that to be heard from the left hand side by the loudspeaker 51 and that to be heard from the back by the loudspeaker 52. Consequently the loudspeakers must be repositioned as indicated. The arrangement is then as listed in Table II.

TABLE II

| Adder | Signal | Loudspeaker | Loudspeaker Position |
|---|---|---|---|
| 45 | 0 + A | 49 | Right |
| 46 | 0 + (phase angle + 90°) | 50 | Front |
| 47 | 0 − A | 51 | Left |
| 48 | 0− A (phase angle + 90°) | 52 | Back |

It will be observed that, with this arrangement, the signals to the right and left loudspeakers 49 and 51 do not require any phase shift. The quadrature component of the azimuth signal indicates the difference between the sound received from the front and from the rear of the transducers (hereinafter called the ambience-difference signal). In practice, it is not usually necessary for the ambience-difference signal to possess the full audio bandwidth and, in particular, the phase shift can have wide tolerance at low frequencies without reducing the subjective directional impressions. It is to be understood that variations may be made to the precise positions of the speakers and the phase angles in order to vary the subjective effects experienced.

As an alternative to moving the positions of the loudspeakers to enable the FIG. 5 receiver to be used with the transmitting apparatus shown in FIGS. 7 and 8, a phase shifting circuit applying a phae shift of 135° may be connected between the input from the azimuth channel A and the phase inverter 42 and the 90° phase shifting circuit 40.

Figure 10:
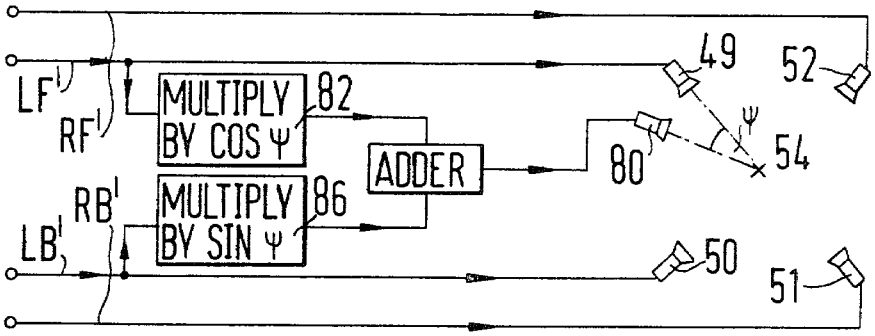
FIG. 10 is a block diagram of part of the apparatus at the receiving end illustrating how an additional loudspeaker may be inserted at an orientation between two of the loudspeakers of the apparatus shown in FIG. 5.

FIG. 10 shows how an additional loudspeaker may be inserted between two of the loudspeakers of the receiver shown in FIG. 5 without using additional phase shifting circuits. The loudspeaker 80 is disposed in the quadrant between the loudspeakers 49 and 50 and subtends an angle $\psi$ at the listening position 54. The loudspeaker 80 is fed from the inputs to the two adjacent loudspeakers 49 and 50. The inputs to the loudspeaker 49 are connected via a circuit 82 which multiplies the amplitude of such input by cos $\psi$ to an adder 84 while the input to the loudspeaker 50 is applied to the adder 84 via a circuit 86 which multiplies its amplitude by sin $\psi$. The output of the adder 84 is connected to the loudspeaker 80. The circuits 82 and 86 may be straight-forward attenuators. A similar technique can, of course, be used to insert additional loudspeakers in the other three quadrants.

Figure 11:
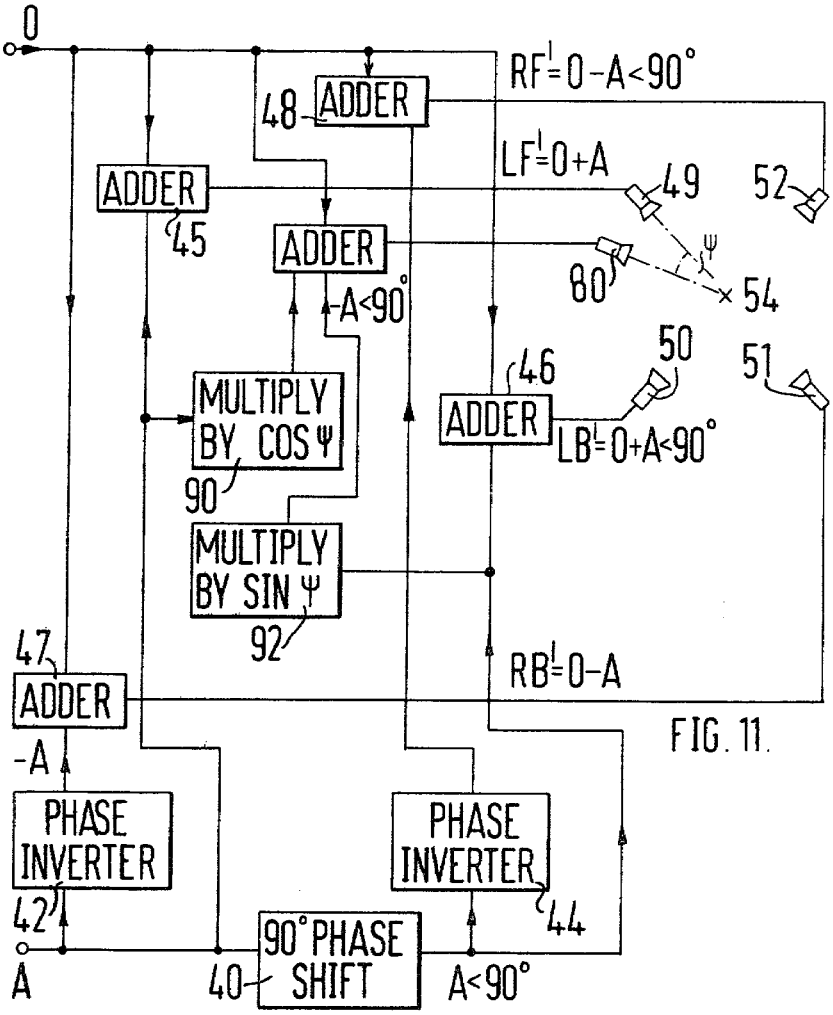
FIG. 11 is a block diagram of the apparatus at the receiving end illustrating an alternative method of inserting an additional loudspeaker at an orientation between two of the loudspeakers of the apparatus shown in FIG. 5.

The arrangement shown in FIG. 10 is a compromise in that it does not give complete cancellation of signals originating from a direction at 180° to the orientation of the loudspeaker 80. FIG. 11 illustrates an alternative to the circuit shown in FIG. 10 which gives complete cancellation for such signals but which involves the making of internal connections to the decoder of FIG. 5. In the circuit shown in FIG. 11, the loudspeaker 80 is fed from an adder 88 which has one input directly connected to the omni-directional input O of the decoder. The adder 88 has two other inputs, one of which is fed via a circuit 90 which multiplies the amplitude of signals passing therethrough by cos $\psi$, to the input of the adder 45 associated with the loudspeaker 49. The third input of the adder 88 is connected via a circuit 92 which multiplies signals passing therethrough by sin $\psi$ to the input of the adder 46 associated with the loudspeaker 50.

Figure 12:
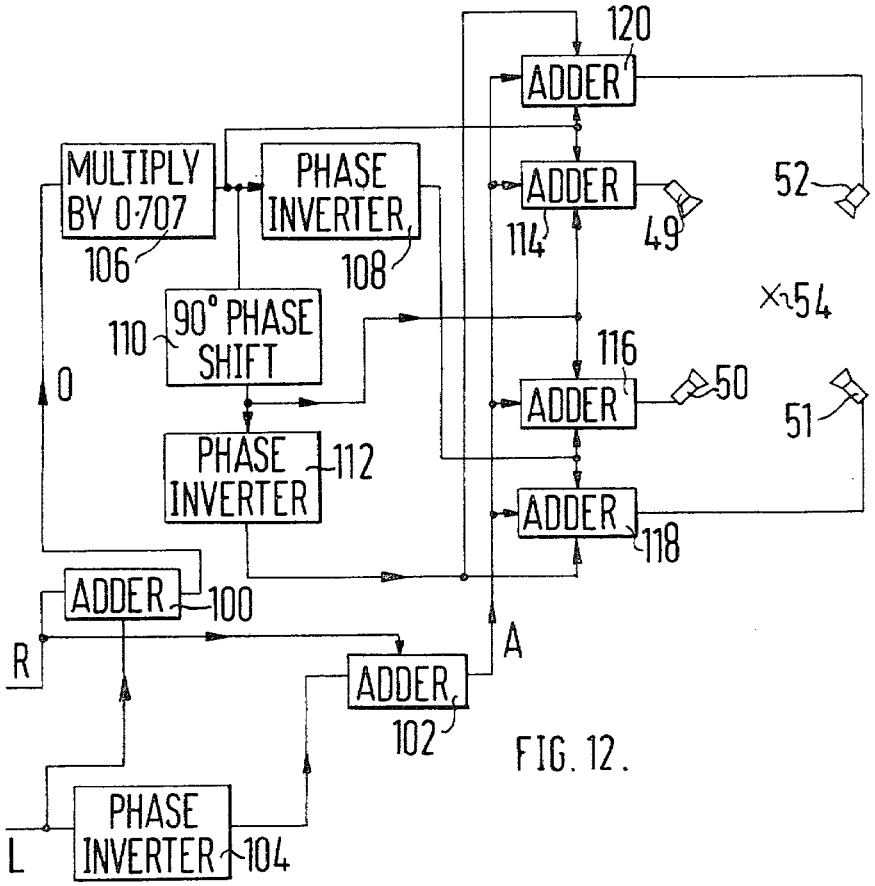
FIG. 12 is a block diagram of apparatus, similar to that shown in FIG. 5 illustrating how the system can be made compatible with existing stereo systems.

FIG. 12 illustrates a modification of the receiver of FIG. 5 in which the two input signals R and L can, if desired be fed to the right and left loudspeakers of a conventional stereo system. The signal at input R is the sum of the azimuth and omni-directional signals A and O and the signal at input L is the difference between the omni-directional and azimuth signals O and A. In order to receover the omni-directional and azimuth signals O and A, the inputs R and L are connected to a first adder 100, the output of which is the omni-directional signal O. The signal at input R is fed directly to an adder 102 and the signal at input L is fed to the adder 102 via a phase inverter 104. The output of the adder 102 is the azimuth signal A. The omni-directional signal O is applied to a multiplier 106 where it is multiplied by 0.707. This is because, as will become apparent, two signals derived from the omni-directional signal O are fed to each loudspeaker and it is therefore necessary to half the power in each such signal so that the total power fed to each loudspeaker from the omni-directional and azimuth signals O and A are equal. The output from the multiplier 106 is fed directly to a phase inverter 108 and via a 90° phase shift circuit 110 to a second phase inverter 112.

The left front loudspeaker 49 is fed from an adder 114 having a first input connected to receive the output of the adder 102, a second input connected to the output of the multiplier 106 and a third input connected to the output of the phase inverter 112. The left back loudspeaker 50 is fed from an adder 116 having a first input connected to receive the output of the adder 102, a second input connected to the output of the 90° phase shift circuit 110 and a third input connected to the output of the phase inverter 108. The right back loudspeaker 51 is fed from an adder 118 which has a first input connected to receive the output of the adder 102, a second input connected to receive the output of the 90° phase shift circuit 110 and a third input connected to the output of the phase inverter 112. The right front loudspeaker 52 is fed from an adder 120 which has a first input connected to receive the output of the adder 102, a second input connected to the output of the multiplier 106 and a third input connected to the output of the phase inverter 112. It will be appreciated that this series of operations is effectively using the technique of FIG. 11 to feed the four loudspeakers from four channels which could be used to feed front back left and right loudspeakers.

The R and L signals can readily be provided at the transmitter by connecting the omni-directional and azimuth signals to an adder (to generate the R signal) and to a different circuit (to generate the L signal).

It will be realised that all forms of the invention are inherently compatible with mono reception, the omni-directional signal being used.

For certain applications where omni-directional and azimuth transducers are used, it may be satisfactory for the transducers to be responsive only or principally in the forward direction, for example, over an azimuth range of $-90°$ to $+90°$, in this case, the phase difference between the omni-directional and azimuth signals may be made a unique function of the azimuth angle only in this azimuth range.

With any embodiment, the microphones may be located within or outside the sound stage. In either case, the relative amplitude of the outputs of the microphones may be arranged to depend on proximity of the sound source, directivity of microphone response of a combination of both.

I claim:

1. A transmitter for a multi-channel sound reproduction system for generating a plurality of audio signals each corresponding to a respective audio source at a particular azimuth with respect to a reference point and having two transmission channels, comprising:

means for forming a first signal component by adding together all the plurality of audio signals to form a sum, phase shift means for introducing predetermined phase shifts in at least all but one of said plurality of audio signals to form a plurality of phase differing signals, one for each of the audio signals, means for combining said phase differing signals to form a second signal component, said first and second signal components being equal to each other in amplitude and frequency but differing from each other in phase in accordance with said predetermined phase shifts, said first and second signal components being coupled to the two transmission channels, the phase differences between said phase differing signals being related to and uniquely characteristic of the respective angles between the directions from which sound represented by the corresponding audio signals is intended to be heard and a predetermined reference direction, said transmitter including an integral transducer unit comprising a first transducer arranged responsive to incident soundwaves to generate a first electrical signal and a second similar transducer arranged to generate a second electrical signal equal in amplitude and frequency to that generated by said first transducer but having a phase which differs from the phase of the signal generated by the first transducer by an amount dependent on the direction of incidence of said soundwaves.

2. A transmitter as claimed in claim 1, in which the first transducer comprises a microphone having an omni-directional response and the second transducer comprises a pair of microphones each having a figure-of-eight variation of sensitivity according to a cosine law, the two figure-of-eight patterns being oriented at right angles to one another in the horizontal plane, the output of said second and third microphones being connected to respective inputs of an adder via circuits adapted to produce a 90° difference between the phases of the output signals therefrom.

3. For use with a sound reproduction system wherein a receiver means couples audio data to at least three separate loudspeakers and wherein audio signals are transmitted to said receiver on only two channels, a transmitter comprising:

means for generating audio signals from sound sources on a sound stage including at least three microphones disposed around the sound stage, coupling means for coupling said audio signals to the two transmission channels, said coupling means comprising a respective coder for each microphone having its input connected to the output of its associated microphone and adapted to supply to the transmission channels the first signal component having amplitude and frequency equal to that of the output of its associated microphone, each of said coders further including means for supplying to the transmission channels the second signal component having amplitude and frequency equal to that of the output of its associated microphone and having a predetermined phase relationship with the corresponding first signal component, the difference in phase between said corresponding first and second signal component corresponding to and being uniquely characteristic of the direction of the corresponding microphone from the center of the sound stage and a predetermined reference direction.

4. For use with a sound reproduction system wherein a receiver means couples audio data to at least three separate loudspeakers and wherein audio signals are transmitted to said receiver on only two channels, a transmitter comprising:

means for generating audio signals from sound sources on a sound stage in which said means for generating audio signals includes an integral transducer unit comprising a first transducer arranged responsive to incident soundwaves to generate a first electrical signal and a second similar transducer arranged to generate a second electrical signal equal in amplitude and frequency to that generated by said first transducer but having a phase which differs from the phase of the signal generated by the first transducer by an amount dependent on the direction of incidence of said soundwaves, coupling means for coupling said audio signals to the two transmission channels, said coupling means including first means for combining the audio signals to form first signal components having amplitudes and frequencies corresponding to the amplitudes and frequencies of the audio signals, said coupling means further including second means for combining the audio signals to form second signal components having amplitudes and frequencies equal to the corresponding first signal components and having phase shifts with respect to the corresponding first signal components, the difference in phase between corresponding first and second signal components being uniquely characteristic of the angle between the direction of the corresponding sound source from the center of the sound stage and a predetermined reference direction.

5. A transmitter as claimed in claim 4, in which the first transducer comprises a microphone having an omni-directional response and the second transducer comprises a pair of microphones each having a figure-of-eight variation of sensitivity according to a cosine law, the two figure-of-eight patterns being oriented at right angles to one another in the horizontal plane, the output of said second and third microphones being connected to respective inputs of an adder via circuits adapted to produce a 90° difference between the phases of the output signals therefrom.

* * * * *